US005892487A

United States Patent [19]

Fujimoto et al.

[11] Patent Number: 5,892,487

[45] Date of Patent: Apr. 6, 1999

[54] ANTENNA SYSTEM

[75] Inventors: Masahiro Fujimoto, Kawasaki, Japan; Ali Louzir, Strasbourg, France

[73] Assignee: Thomson multimedia S.A., Courbevoie, France

[21] Appl. No.: 901,591

[22] Filed: Jul. 28, 1997

Related U.S. Application Data

[63] Continuation of Ser. No. 501,094, filed as PCT/EP94/00482, Feb. 19, 1994, abandoned.

[30] Foreign Application Priority Data

Feb. 28, 1993 [EP] European Pat. Off. ..... 93400507

[51] Int. Cl.[6] ..... H01Q 13/12; H01Q 19/12

[52] U.S. Cl. ..... 343/840; 343/767; 343/769

[58] Field of Search ..... 343/840, 767, 343/700 MS, 769, 768; H01Q 1/38, 13/12, 19/12

[56] References Cited

U.S. PATENT DOCUMENTS

| | | | |
|---|---|---|---|
| 3,665,480 | 5/1972 | Fassett | 343/754 |
| 4,208,660 | 6/1980 | McOwen, Jr. | 343/769 |
| 4,893,126 | 1/1990 | Evans | 343/700 MS |
| 4,929,959 | 5/1990 | Sorbello et al. | 343/700 |
| 5,272,485 | 12/1993 | Mason et al. | 343/700 MS |
| 5,416,971 | 5/1995 | Hegazi et al. | 343/770 |

FOREIGN PATENT DOCUMENTS

| | | |
|---|---|---|
| 0528175 | 2/1993 | European Pat. Off. . |
| 3134122 | 3/1983 | Germany . |
| 2242316 | 9/1991 | United Kingdom . |

*Primary Examiner*—Hoanganh Le

*Attorney, Agent, or Firm*—Joseph S. Tripoli; Frederick A. Wein

[57] ABSTRACT

A feeder for a microwave antenna system which can be integrated together with electronic circuitry on a common circuit board. A slot antenna, preferably shaped as an annular slot, is provided on the circuit board, and can be etched on the backside of the circuit board, which is normally a ground plate. The antenna system can be used for reception of DBS signals.

5 Claims, 5 Drawing Sheets

ANTENNA SYSTEM

This is a continuation of application Ser. No. 08/501,094, filed as PCT/EP94/00482, Feb. 19, 1994,now abandoned.

BACKGROUND

The present invention relates to an antenna system according to the generic part of claim 1.

It is generally known to receive radiofrequency signals with frequency values above hundreds Megahertz, corresponding to wavelengths of less than about 50 centimeters, with the aid of a parabolic reflector and a feeder located at the focal point of said reflector.

It is further known to use other focussing means as the parabolic reflector, e.g. a dielectric lens. Antenna systems using dielectric lenses, such as a Luneburg-type or a homogeneous-type lens, are known for example from the international publication WO 92/13373, where such a lens is used in conjunction with a helical antenna.

The known kinds of feeders, such as feeder horns and helical antennas, require waveguides or coaxial lines to lead the received signals to associated electronic means, such as a low noise block (LNB). Such a weveguide-solution is bulky and complicated. As it uses two kinds of technologies, waveguide for the feed and microstrip for the LNB, it is a quite expensive product.

It is further known, e.g. from the article "MICROSTRIP ARRAY FOR RFLECTOR FEED APPLICATIONS", P. S. Hall et al., Conference Proceedings of the 14th European Microwave Conference in Liege, Sep. 10–13, 1984; pages 631–636, to use a small array of conventional microstrip patches as antenna feed for just one polarization and a relatively narrow frequency band width.

It is further known, e.g. from "ANTENNA ENGINEERING HANDBOOK", second edition, R. C. Johnson et al., McGraw-Hill Book Company, 1989; chapter 8, to use slot antennas. Such antennas may have a rectangular, an annular shape or the like.

It is an object of the present invention to present an antenna system with concentration means, such as a dielectric lens antenna or a parabolic reflector, and a light weight and compact feed which can be directly integrated with rear-positioned electronical means, such as a low noise block (LNB).

This object is realised by an antenna system according to claim 1. Further developments are given by the sub-claims.

According to the present invention an antenna element for the reception of radiofrequency signals and especially for microwave signals is a slot antenna and is arranged on the same board as electronical means for processing the signals received by the antenna element.

The invention has the advantage, compared to existing microstrip arrays, that there is less pattern disturbance by feeding circuits and that a better integration to the feed is possible by lower dimensions and by saving some components.

It is preferred to give the antenna element the shape of an annular slot. This has the advantages of a good polarization diversity and of a wide frequency bandwidth coverage.

In a development of the invention the slot antenna is etched in the backside of the board used for the rear-positioned electronic means. This backside can be outside of the antenna area e.g. the conductor for ground.

BRIEF DESCRIPTION OF THE DRAWINGS

Further characteristics, advantages and details of the invention will be explained in the following embodiments with the aid of the drawings.

Wherein.

DETAILED DESCRIPTION OF THE PREFERRED EMBODIMENT

Figure 1:
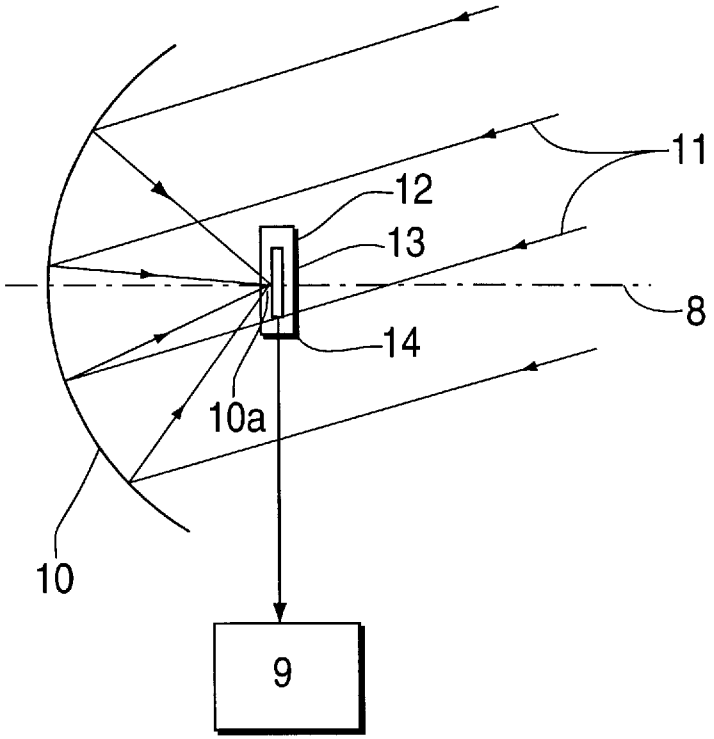
FIG. 1 shows a first embodiment using a parabolical reflector.

FIG. 1 shows a parabolical reflector 10 which focusses an incoming radiation 11 at a focal point 10*a* where a low noise block (LNB) 12 is located having a housing 14 and a circuit board 13. The LNB 12 includes an integrated feed, which can also be called primary radiator and this feed will be explained in more detail later with the aid of FIG. 3 to 8. The LNB 12 gives its signal, normally an intermediate frequency (IF) signal, to a broadcasting receiver, which is indicated by the block 9 and this receiver processes the signal such that according audio, video and/or data signals are made available for a user or for further means to be controlled.

Figure 2:
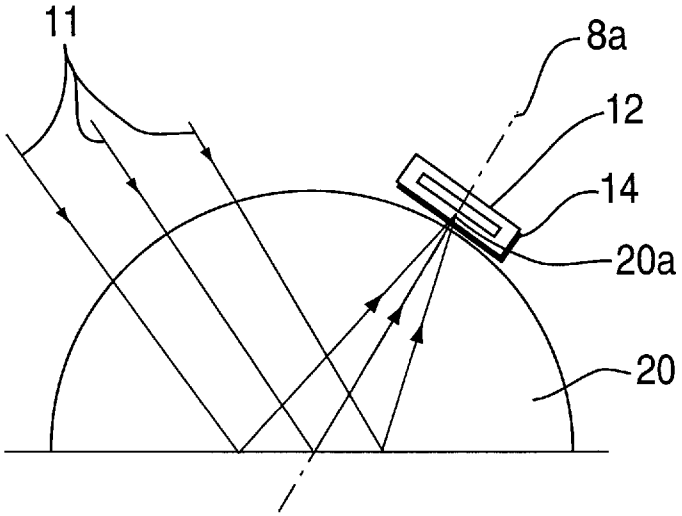
FIG. 2 shows an arrangement using a Luneburg-type lens.

In FIG. 2 there is a hemi-spherical Luneburg-type lens 20 used as focussing means which focusses the incoming radiation 11 at a focal point 20*a*. The refraction index of the lens 20 is such that the focal point 20*a* is located near, but outside of the lens-surface.

Figure 3A:
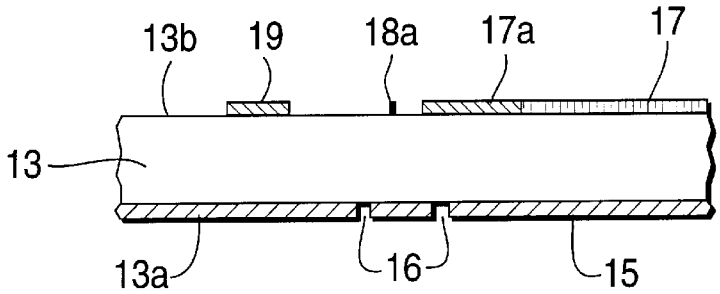
FIGS. 3*a* and 3*b* show details of the feeder shown in FIG. 1 and 2.
Figure 3B:
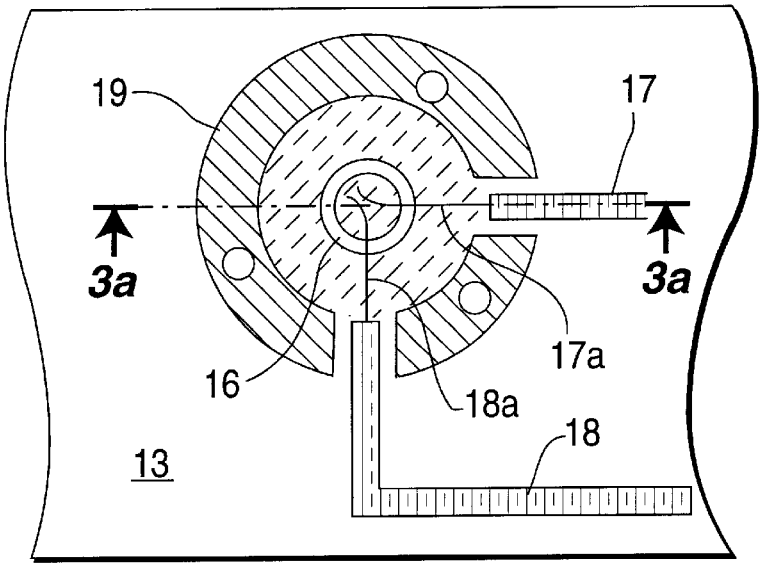

The circuit board 13 is shown in more detail in FIG. 3, including FIG. 3*a,* which shows a side-view of the circuit board 13 along the axis A—A of FIG. 3*b,* which shows a top-view of the circuit board 13. On the lower board side 13*a* there is a metallic plane 15 provided, which can be connected e.g. to ground. Inside this ground-plane 15 there is an annular slot 16 provided, which works as an annular slot antenna for the radiation focussed at the focal point 10*a*. On the upper side 13*b* of the board 13 there is a first microstrip line 17 provided with a stub 17*a,* which receives signals of a first polarization, e.g. horizontal. For the reception of a second polarization, orthogonal to the first one, there is a second microstrip line 18 provided having an according stub 18*a*. The microstrip lines 17, 18 lead their signals to according inputs of rear-positioned electronical means of the LNB 12. These electronical means are positioned on the upper side of the board 13, but are not shown due to reasons of clearness.

The dimensions and the shapes of the stubs 17*a,* 18*a* are optimized to achieve a wide frequency bandwidth and a good isolation between the orthogonal polarizations.

In the embodiments of FIG. 1 and 2 the board 13 is such provided that its broadside is directed to or around the center of the reflector 10 or of the lens 20, respectively and that the lower board-side 13*a* is nearer to the reflector 10 or the lens 20, respectively, than the upper board-side 13*b*.

It may be mentioned that it is also possible to position the upper side 13*b* nearer to the reflector 10 or to the lens than the lower side 13*a* though this may effect pattern disturbances and a more difficult construction of the housing 14.

The radiation generated by the annular slot 16 and initiated by the focussed wave 11 is bidirectional with two maximas at the broadside of the board 13. To obtain an unidirectional beam, a closed backed metallic cavity is installed in the embodiment shown in FIG. 4. A metal part 30 has a first foot-bridge 31, which is in electrical contact with the ring 19, and a second foot-bridge 32 with an isolation 33 at its lower end so that an electrical contact between the part 30 and the strip line 17 is avoided. The foot-bridges 31,32 build together with the according horizontal connection of the part 30 a cavity with a height H to the upper board-side 13*b* of about

Figure 4:
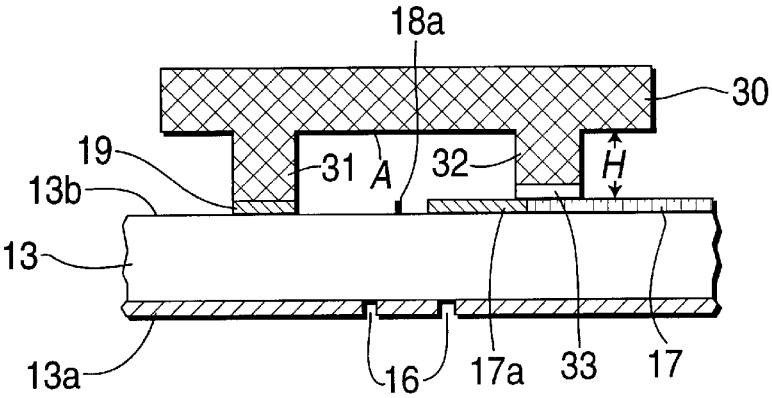
FIG. 4–8 show different embodiments of feeders suitable for using in the embodiments of FIG. 1 and FIG. 2.

L/4, where L is the wavelength of the radiation to be received. It may be mentioned that the dimensions in FIG. 4 are such to explain this embodiment quite clearly. In reality the thickness of the board 13 and of the lines 17, 18, 19 etc. are much smaller than the height H. This means that the height of about L/4 is also nearly the distance between the annular slot and a point A.

Figure 5:
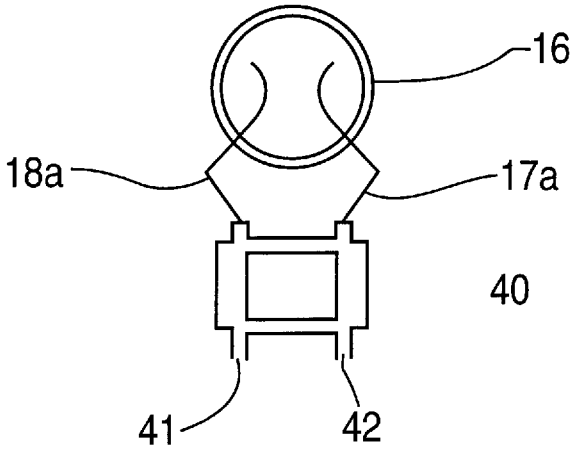

The polarization of the wave radiated by the annular slot 16 is originally linear. The embodiment indicated in FIG. 5 is suitable for the reception of circular polarisations. Therefore there can be used an hybrid couple 40. At a first output is a first circular polarization available, e.g. right hand circular polarization (RHCP), and at a second output 42 is the other circular polarization available, e.g. left hand circular polarizations (LHCP).

Figure 6:
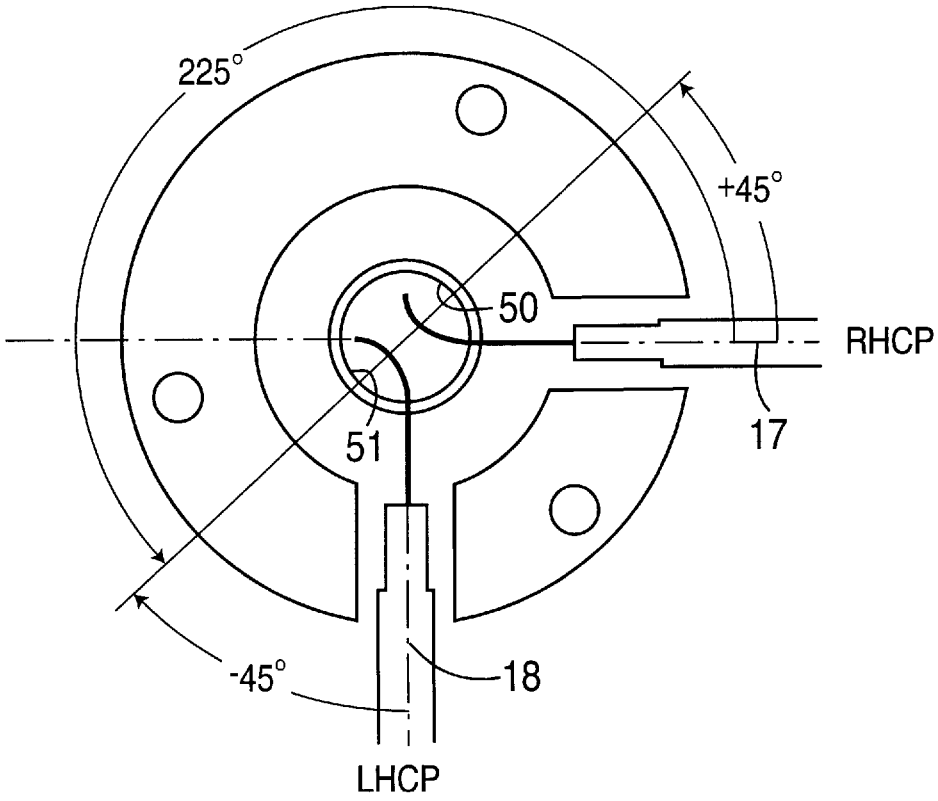

Another embodiment for the reception of circular polarized signals is shown in FIG. 6. A first small perturbation segment 50 is provided at +45 degrees and a second small perturbation segment 51 is provided at +225 degrees from the axis of the feeding point (microstrip line) 17. These segments 50, 51 are at the lower boardside 13*a* and correspond to a distortion of the annular slot 16. By these segments 50, 51 a RHCP is realized at the line 17. Compared to the axis of the feeding point (microstrip line) 18 the perturbation segments 51, 50 are arranged in about −45 degrees and −225 degrees respectively. Thereby the reception of LHCP is realized at line 18.

Figure 7:
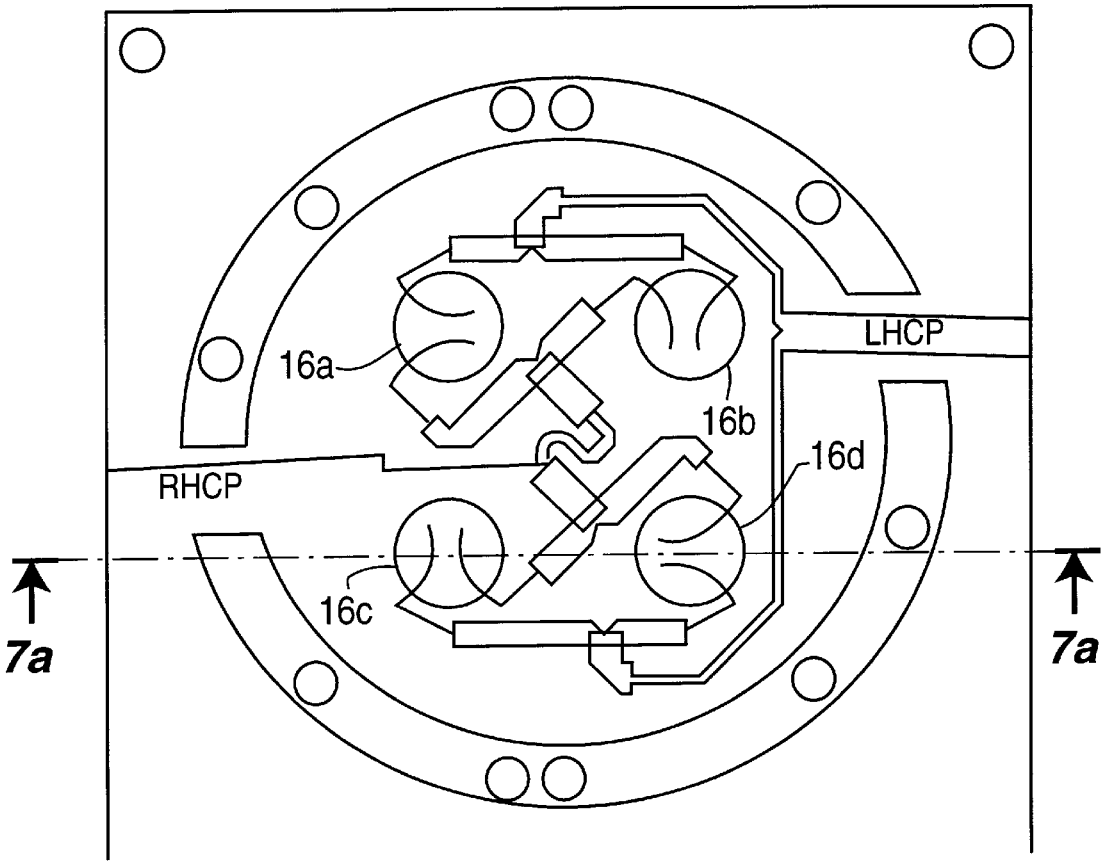
Figure 7A:
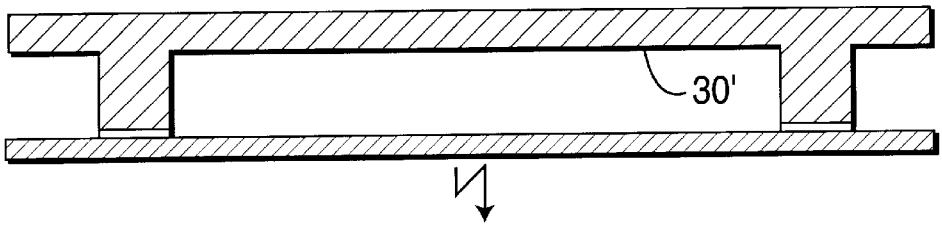

FIG. 7, including FIG. 7*b* showing a top-view of the circuit board 13, and FIG. 7*a,* showing a cut along A—A of FIG. 7*b,* presents an embodiment where it is possible to reach a specified illumination of the focussing means 10 or 20 respectively. A few annular slots, e.g. four one of 16*a,* 16*b,* 16*c,* 16*d* like shown in FIG. 7, can be grouped in a small array, arranged in a certain way and fed with an adequate power distribution circuit, thus to achieve wider frequency bandwidth and higher polarization performance. In this case a common back cavity 30' can be used instead of individual cavities. Thus permits closer inter-element spacing and then could be used with a wider range of focussing antenna parameters, such as the ratio of the focal length F to the diameter D of the focussing means 10, 20 respectively:

F/D.

The smaller F/D, the closer is the feed to the focussing means, the wider is the needed feed beamwidth which gives the illumination.

Also other parameters can be achieved.

Another solution to achieve a specified illumination is to cover the single radiation element by a small dielectric lens having spherical, cylindrical, planar or any other shape while maintaining a small feed cross section. Such a method has already been proposed by C. M. Hall et al. in the article "MICROSTRIP PATCH ARRAYS WITH SPHERICAL DIELECTRIC OVERLAYS"; published on pages 89–93 of the book "Advanced Antenna Technology", Vol. 2; MICROWAVE EXHIBITIONS & PUBLISHERS, 1987 (ISBN 094682195X)

Therefore further explanations for this principle seems not to be necessary.

Figure 8A:
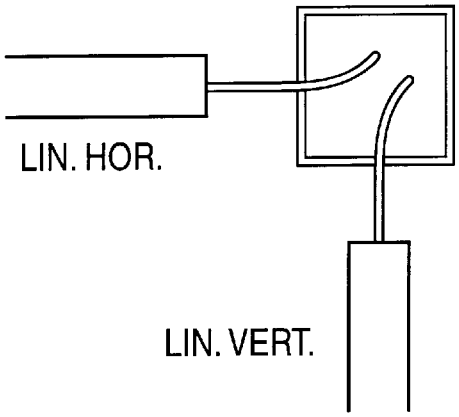
Figure 8B:
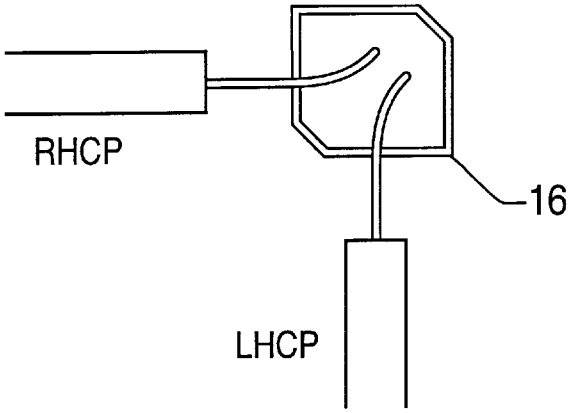
Figure 8C:
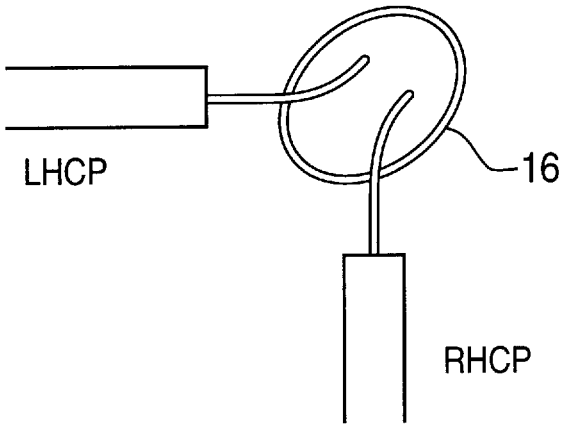

Versions of the described embodiments may include at least one of the following variations:

Instead of an annular shape, the slot 16, 16*a,* . . . may have any other suitable shape, e.g. like shown in FIG. 8.

For the housing any material suitable for passing of the received wave 11 can be taken. Additionally or instead it is possible to provide an aperture in the area of the slots 16.

The circuit board can be arranged at the end of a closed waveguide, with a distance between the end of this waveguide and of the circuit board of about L/4.

What is claimed is:

1. Antenna system comprising:

a parabolic reflector for focussing incoming radiation, and a feeder capable of feeding polarized waves, the feeder including a circuit board on which a single annular slot and a low noise block are arranged, said annular slot acting as an annular slot antenna for the focussed radiation and being provided on a ground plate of the circuit board, and a hybrid coupler with a first waveform stub positioned in the slot for receiving a first polarized signal and a second waveform stub positioned in the slot for receiving a second polarized signal.

2. Antenna system according to claim 1, wherein a cavity is installed on the side opposite of the slot antenna and is provided to concentrate the radiation into one direction.

3. The antenna system as recited in claim 1, wherein a phase of said first and second polarized signals are dependent upon a position of said first and second stubs about said annular slot.

4. The antenna system as recited in claim 1, wherein said first and second polarized signals are in quadrature phase.

5. Antenna system comprising:

a focussing means, a feeder capable of feeding polarized waves, the feeder including a circuit board on which a single annular slot antenna and electronic means of a low noise block are arranged, and perturbation elements provided for the reception of circularly polarized signals and include a first perturbation segment provided at plus 45 degrees and a second perturbation segment provided at plus 225 degrees from an axis of an output feed.

* * * * *